US005662465A

United States Patent [19]

Kano

[11] Patent Number: 5,662,465

[45] Date of Patent: Sep. 2, 1997

[54] CONTROLLING FLOW OF FUEL GAS TO A BURNER

[75] Inventor: Yoshio W. Kano, Barrington, Ill.

[73] Assignee: Eaton Corporation, Cleveland, Ohio

[21] Appl. No.: 489,207

[22] Filed: Jun. 9, 1995

[51] Int. Cl.[6] ..... F23N 5/00

[52] U.S. Cl. ..... 431/12; 431/75; 431/78; 126/19 R; 126/39 BA; 126/39 G; 251/96; 251/205

[58] Field of Search ..... 126/21 R, 21 A, 126/41 R, 39 BA, 39 R, 39 N, 39 J, 39 E, 19 R; 431/6, 12, 75, 78; 251/96, 100, 205

[56] References Cited

U.S. PATENT DOCUMENTS

| | | | |
|---|---|---|---|
| 3,693,874 | 9/1972 | Fox | 251/96 |
| 4,029,291 | 6/1977 | Carlson | 251/96 |
| 4,137,945 | 2/1979 | Cutts | 251/96 |
| 4,480,628 | 11/1984 | Simpson | 126/21 A |
| 5,099,822 | 3/1992 | Cramer et al. | 126/39 BA |
| 5,400,766 | 3/1995 | Dillon | 126/42 |
| 5,544,856 | 8/1996 | King et al. | 251/205 |

*Primary Examiner*—James C. Yeung
*Attorney, Agent, or Firm*—Roger A. Johnston

[57] ABSTRACT

An electronic control system for gaseous fuel burners, particularly suitable for ovens and employs a single push-to-turn user control knob for selecting BAKE, BROIL or SELF-CLEAN modes of operation and for setting the oven temperature desired in the BAKE mode, the control knob turns a potentiometer shaft which provides a signal indicative of the shaft position to a microprocessor which controls relays for selectively opening and closing electrically operated BAKE and BROIL burner valves.

15 Claims, 6 Drawing Sheets

CONTROLLING FLOW OF FUEL GAS TO A BURNER

BACKGROUND OF THE INVENTION

The present invention relates to controls for ovens employing gaseous fuel burners and particularly relates to cooking appliances having a plurality of individual gas burners for cooking. Typically in household cooking appliances having open burners on the cooktop and an enclosed burner for the oven utilize rotary control knobs on the shaft of the burner valve for the individual top burners and separate knobs on the shaft of the oven burner valves. Such arrangements have required the oven control valve to thus be located behind the knob control panel. This has required added fuel gas conduits and has thus added cost to the manufacturing in mass production. It has therefore been desired to utilize remotely controlled electrically operated valves for controlling fuel gas flow to oven burners.

Where electrically operated valves have been employed for oven burners used in mass produced household cooking appliances, thermostatically operated switches have been used to cycle the burner valve in response to changes in the oven temperature. This type of arrangement has created problems in designing the oven controls, in order to have the control knob for temperature regulation located on the control console for user convenience and yet provide the thermostatic control of the switch for the valve in response to sensed changes in oven temperature.

Because the sensor must be located in the oven, the remote location of the control knob has complicated the connections to the thermostat.

In order to improve the sophistication of control and simplify the control arrangements and reduce manufacturing cost, it has been desired to employ electronic controls for oven temperature regulation, yet retain the familiar rotary control knob for temperature selection which has acquired widespread user acceptance. The employment of all electronic control for gaseous fuel flow to an oven burner enables the gas valve and thermostat to be located remotely from the user control knob in order to simplify the fuel supply conduits to the oven burners.

The push to unlock and turn actuation of the user control knob has also achieved wide acceptance to provide tactile feedback that of the valve closed or "OFF" setting positions of the rotary control knob and to prevent inadvertent turning of the control.

Thus it has been desired to find a simplified and low cost way of providing push to turn control input for an all electronic control for an oven gas burner system in a manner which is easy to assemble and provides relatively low manufacturing cost in high volume production.

SUMMARY OF THE INVENTION

It is an object of the present invention to provide an all-electronic control system for controlling flow of gaseous fuel to an oven burner and utilizes the push to turn actuated rotary temperature selector to enable the user to turn on the oven and select the desired oven temperature with a single rotary control.

It is a further object of the present invention to provide all electronic control of gaseous fuel flow to an oven burner with a single push to turn rotary knob input for user oven turn on and temperature selection.

The present invention utilizes a potentiometer attached to the oven control console with a push to unlock and rotary actuation for turning on the oven and selecting the desired oven temperature.

It is a further object of the present invention to provide a potentiometer for oven control and temperature selection with the potentiometer mounted behind a control panel and a knob engaging the potentiometer shaft through the panel with push to turn release and actuation.

BRIEF DESCRIPTION OF THE DRAWINGS

FIG. 8 is a front elevation view of the structure of FIG. 7; and,

FIG. 9 is a section view taken along section indicating lines 9—9 of FIG. 8.

DETAILED DESCRIPTION

Figure 1:
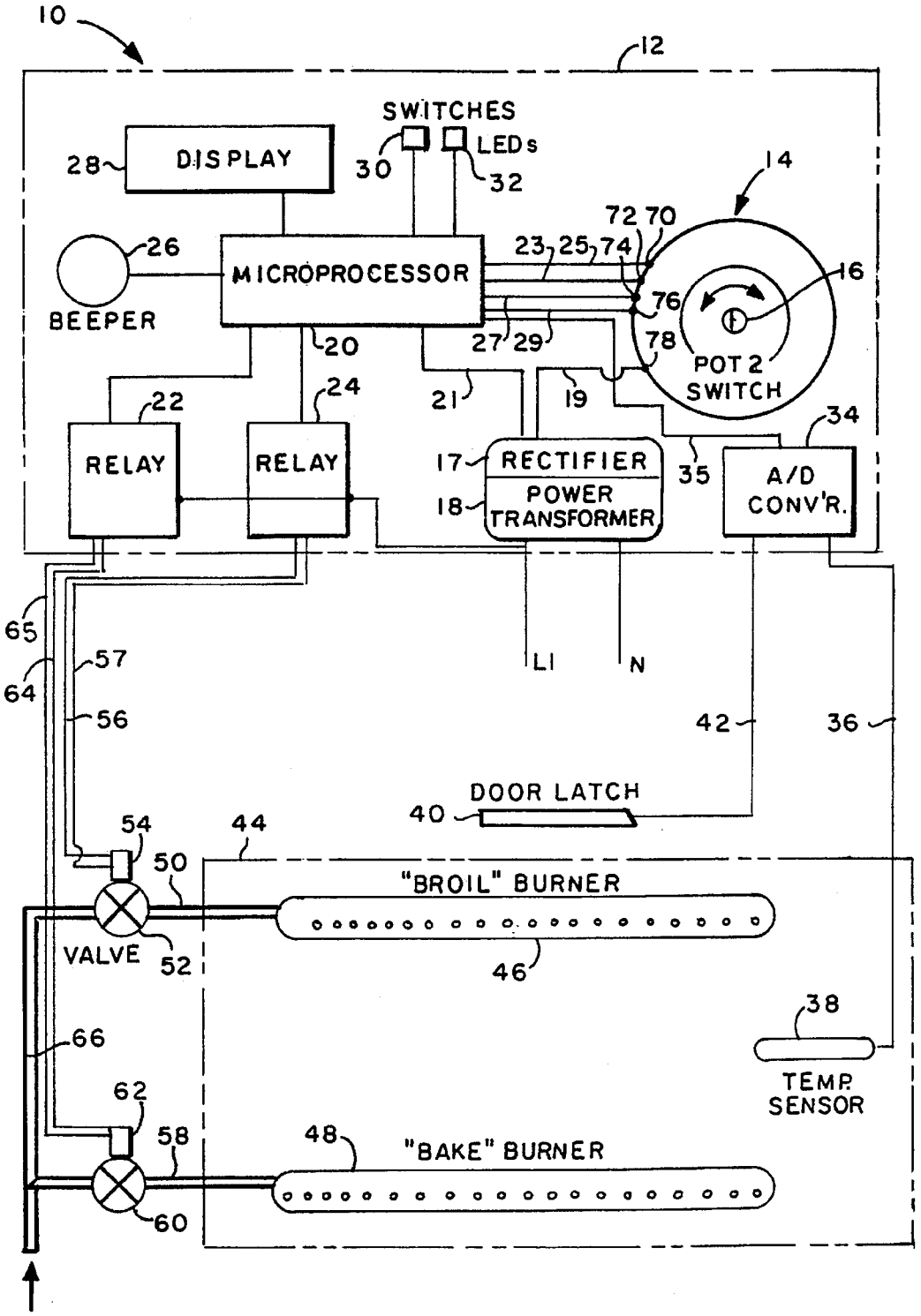
FIG. 1 is a block diagram of the electronic control system for oven gas flow control of the present invention.

Referring to FIG. 1, the control system of the present invention is indicated generally at 10 and has a control housing 12 indicated by dashed outline which has mounted thereon a potentiometer indicated generally at 14 and which has a shaft 16 extending outwardly of the housing 12. A power supply in the form of a transformer 18 is connected to power lines denoted L1 and N and provides low voltage DC power through rectifier 17 to a microprocessor 20. The microprocessor provides outputs to a pair of burner relays 22, 24, an audio alarm 26 and a visual display 28 and indicator lights 30, 32 for indicating the state of the user controls. An analog-to-digital (A/D) convertor 34 receives analog voltage signals along line 36 from an oven temperature sensor 38 which may for example, be a thermistor; and, convertor 34 receives an electrical signal from the door latch position indicator 40 along line 42. The A/D convertor provides the digital signals along line 35 to the microprocessor 20. The oven, denoted by dashed outline and reference numeral 44, has disposed therein a gaseous fuel burner for performing a "BROIL" function denoted by reference numeral 46 and a gaseous fuel burner for performing the "BAKE" function denoted by reference numeral 48. Burner 46 is supplied along fuel conduit 50 by a valve 52 operated electrically by an operator 54 which may be a solenoid, and which is connected electrically along leads 56, 57 to relay 22.

Oven BAKE burner 48 is supplied by fuel supply conduit 58 connected to the outlet of a gaseous fuel valve 60 electrically operated by operator 62 which, in the present practice of the invention, as a solenoid, supplied along lines 64, 65 from relay 24.

The inlets of valves 52 and 60 are connected to a manifold 66 adapted for connection to a source of gaseous fuel such as a container of liquefied petroleum gas or a natural gas supply line.

Figure 2:
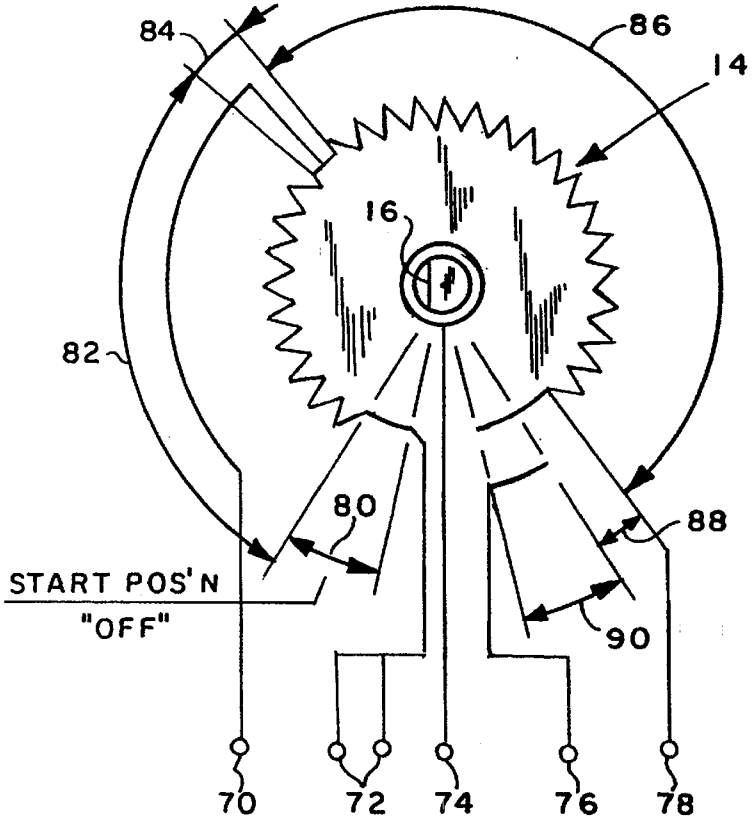
FIG. 2 is a schematic of the potentiometer employed in the control system of the present invention.

Referring to FIGS. 1 and 2, potentiometer 14 has a terminal 70 thereof connected to a low voltage lead 25 from the microprocessor, typically 2.5 volts, with the terminal 72 connected to ground. The wiper or output terminal 74 is connected along lead 27 to the microprocessor; and, terminal 76 is connected along lead 29 to the microprocessor and represents the auto-clean function. Terminal 78 is connected to the power supply 17 along lead 19 and receives a five volt DC supply of power.

Referring to FIG. 2, when the potentiometer wiper is in the arcuate region denoted by reference numeral 80, terminal 74 is connected to the grounded terminal 72 and the controller is in the "OFF" condition. When the wiper is rotated in the clockwise direction from arcuate region 80 to any position within the arc denoted by reference numeral 82, the wiper terminal 74 receives a voltage equivalent to the voltage applied to terminal 70 reduced by the proportion of the resistance between the wiper position and the upper end of the arc 82 as a percentage of the full length of the arc 82 which the microprocessor utilizes to turn on the BAKE burner 48.

Upon the wiper being rotated clockwise from arc 82 into the region denoted by the arc 84 the wiper experiences the voltage equal to one-half the full DC supply voltage which in the present practice of the invention gives a voltage of 2.5 volts DC in the arc region denoted by reference numeral 84.

Continued rotation of the wiper from arcuate region 84 through the arcuate region denoted by reference numeral 86 increases the voltage applied to the microprocessor for controlling the "BAKE" burner until the wiper reaches the end of the potentiometer resistance whereupon the full supply voltage applied at terminal 78 is applied to the wiper to provide a full 5 volts DC to the microprocessor for signaling maximum "BAKE" burner temperature.

The position of the connection of terminal 70 to the potentiometer resistance element in the arcuate segment 84 is chosen slightly below the center of the potentiometer element to provide the midpoint of the supply voltage to the potentiometer slightly below a voltage corresponding to an oven temperature of 300° Fahrenheit, this arrangement prevents the flattening of the potentiometer current-versus-position (rotation) relationship in the critical range 300°–350° Fahrenheit where a high percentage of baking is performed. The application of the calibrated voltage comprising one-half of the full scale voltage at a selected intermediate point in the potentiometer resistor insures that the potentiometer will provide that voltage at that selected rotational position and therefore eliminates the need for full scale calibration of potentiometer in mass production.

Referring to FIG. 2, continued clockwise rotation of the potentiometer wiper from the full voltage position in arc segment 86 to the arc segment 88 signals the microprocessor to switch to the "BROIL" burner; and, further clockwise rotation of the potentiometer wiper to the arc segment denoted by reference numeral 90 applies the full 5 volts DC to terminal 76 and signals the microprocessor to turn on both the "BAKE" and "BROIL" burner for the SELF-CLEAN mode of operation of the oven. In the practice of the invention it has been found satisfactory to use a value of 19° for arc segment 80, 96° for arc segment 82, 11° for arc segment 84, 173° for arc segment 86, 16° for arc segment 88 and 18° for arc segment 90.

Figure 3:
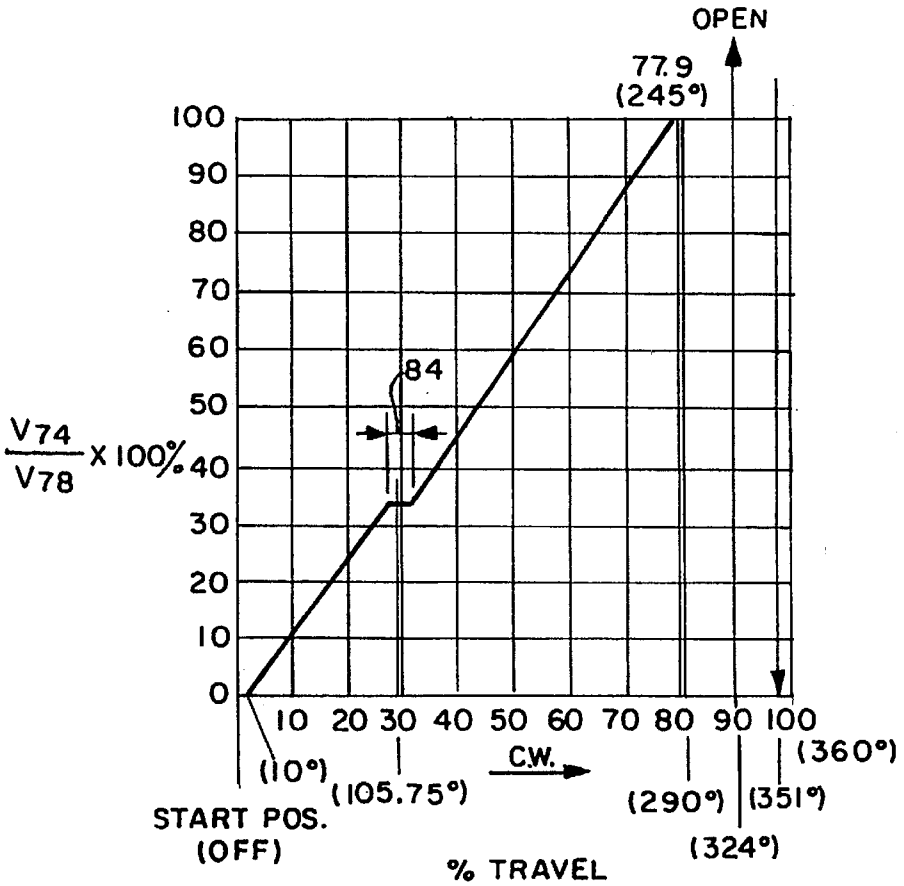
FIG. 3 is a graphical representation of the voltage output of the potentiometer wiper as a function of shaft rotation for the potentiometer employed in the present invention.

Referring to FIG. 3, the percentage of full scale voltage comprising the ratio of the voltage measured by the wiper on terminal 74 divided by the voltage provided at terminal 78 is plotted as the ordinate and the percentage of clockwise rotation of the potentiometer is plotted as the abscissa for a typical potentiometer. FIG. 3 shows the general linearity of the relationship and the step formed by the mid-range voltage tap of arcuate segment 84.

Figure 4:
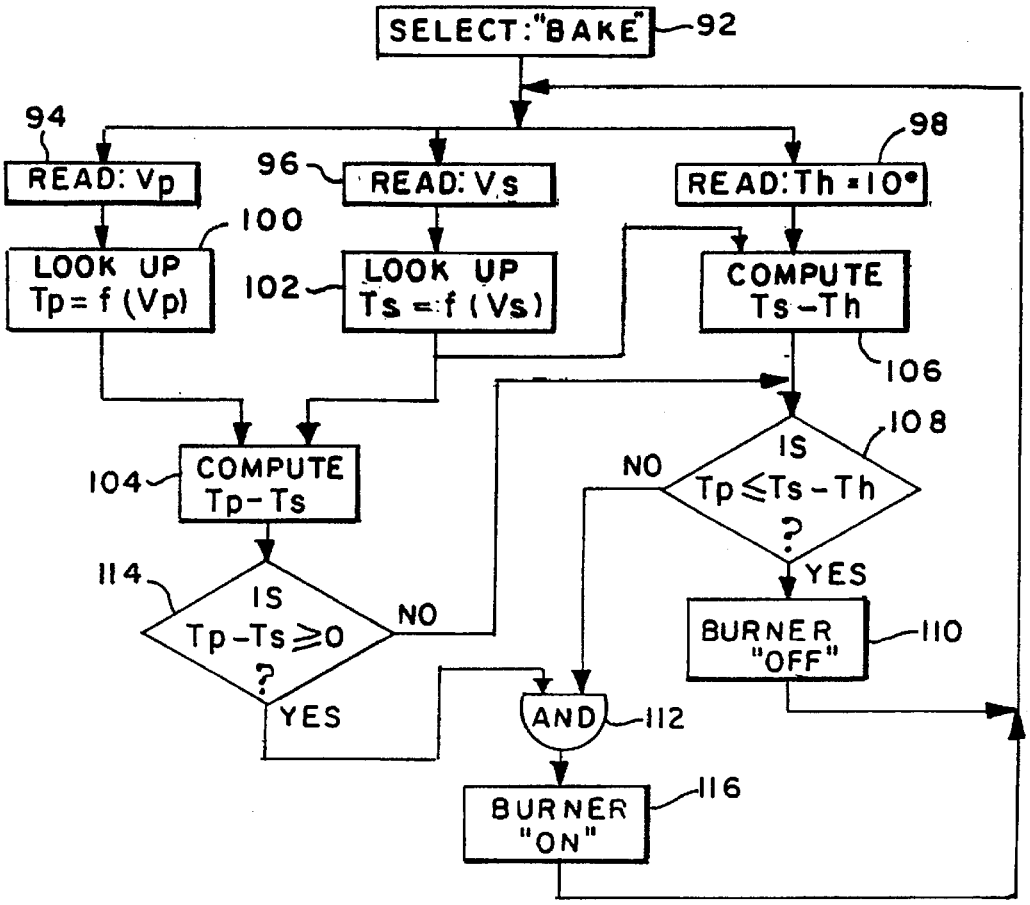
FIG. 4 is a block flow diagram of the control logic for an oven BAKE burner for the present invention.

Referring to FIGS. 2 and 4, upon user rotation of a control knob (see FIG. 9) attached to the potentiometer shaft 16 such that the wiper of potentiometer 14 is in the arcuate segment 82, "BAKE" burner operation and temperature setting is selected at step 92 and the control system proceeds to step 94 to read the potentiometer voltage $V_P$ from wiper terminal 74 along lead 27. The system also proceeds from step 92 to step 96 and reads the voltage output from the temperature sensor 38 which is inputted to the A to D convertor 34 along line 36 and the digitized temperature signal from converter 34 which is inputted to the microprocessor along line 35.

The system also proceeds from step 92 to step 98 to read a programmed deadband or temperature differential $T_h$, which in the present practice of the invention is set at 10° F.

The system proceeds from step 94 to look up the temperature selected by the potentiometer 16 from a table of values of the selected temperature $T_P$ corresponding to values of the potentiometer wiper voltage $V_P$ at step 100; and, proceeds from step 96 to step 102 to look up values of the oven temperature $T_S$ from a table of values of the oven temperature as a function of the sensor voltage $V_S$. The system then proceeds from steps 100 and 102 to step 104 and computes the difference between the selected temperature $T_P$ and oven temperature $T_S$. From steps 102 and 98 the value $T_S$ is also utilized at step 106 to compute the difference between $T_S$ and $T_h$. The system proceeds from step 106 to step 108 and determines whether $T_P$ is equal to or less than the difference computed in step 106; and, if the determination in step 108 is affirmative, the system proceeds to step 110 to turn the burner off and recycles to steps 94, 96, 98.

If the determination at step 108 is negative, the system proceeds to one input of AND logic device 112.

From step 104 the system proceeds to step 114 where a determination is made whether $T_P$ less $T_S$ provides a differential equal to or greater than zero; and, if the determination in step 114 is in the affirmative, the system proceeds to the remaining input of AND gate 112 which is enabled and proceeds to step 116 to turn on the burner and the system returns to steps 94, 96, 98. If the determination at step 114 is negative, the system returns to step 108.

Figure 5:
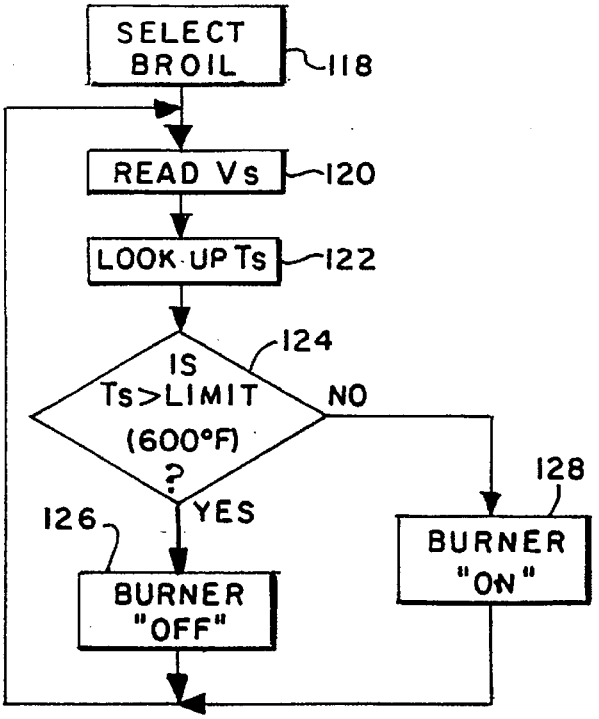
FIG. 5 is a block flow diagram of the logic for control of the BROIL burner for an oven employing the present invention; and, FIG. 6 is a block flow diagram of the control logic for the SELF-CLEAN mode of operation of an oven employing the control system of the present invention.

Referring to FIGS. 1, 2 and 5, the system operation logic is shown for the operational mode wherein the user has rotated potentiometer shaft 16 to a position such that the wiper thereof is in the arcuate region denoted by reference numeral 88 whereupon the 5 volt DC power from lead 19 is supplied to terminal 78 and is applied through the wiper and terminal 74 along lead 27 to the microprocessor. The system then proceeds to step 118 to select the BROIL burner; and, the system proceeds to step 120 to read the voltage $V_S$ from the sensor 38 as digitized and supplied to the microprocessor 20 along line 35. The system then performs a lookup of $T_S$ from values of $V_S$ and proceeds to step 124 and makes a determination whether $T_S$ is greater than a preset limit which in the present practice is chosen as 600° F.

If the determination in step 124 is affirmative the system proceeds to turn the BROIL burner off and recycles to step 120. If the determination at step 124 is negative, indicating that the oven temperature is below the 600° F. upper limit, the burner is then turned on at step 128 and the system recycles to step 120.

Figure 6:
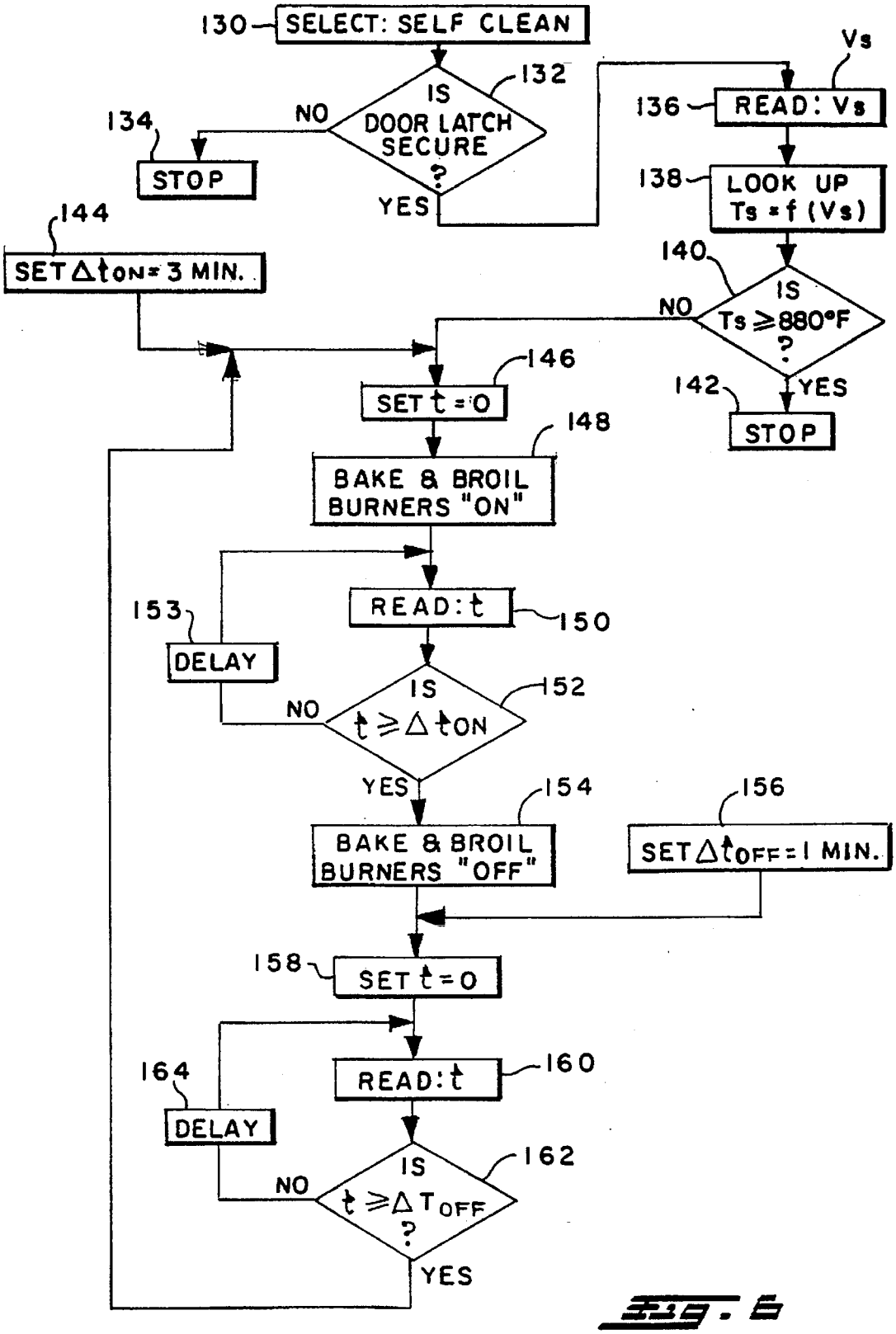

Referring to FIGS. 1, 2 and 6, upon the user turning the potentiometer wiper to a position corresponding to arcuate region 90, the voltage applied to terminal 78 is outputted to potentiometer terminal 76 and along lead 29 to the microprocessor. The system then proceeds to step 130 to select the SELF CLEAN mode of operation and proceeds to step 132 for a determination as to whether the door latch 40 is secure. If the determination at step 132 is negative, the system proceeds to step 134 and halts. If the determination at step 132 is in the affirmative, the system proceeds to step 136 and reads the value of $V_S$ and then proceeds to step 138 to determine from a look up table the corresponding value of $T_S$.

The system proceeds from step 138 to step 140 and a determination is then made at step 140 whether $T_S$ is equal to or greater than a limit temperature of 880° F.; and, if the determination at step 140 is affirmative, the system proceeds to step 142 and does not proceed further.

The system is set at step 144 for a sampling rate $\Delta t_{ON}$, which in the present practice of the invention has been found satisfactory if set for an elapsed period of time of three minutes. The system then proceeds from step 144 to step 146 and sets time t=zero and proceeds to step 148 to turn on both the BAKE and BROIL burners 46, 48.

The system then proceeds from step 148 to step 150 and reads Time t and then proceeds to step 152 and makes a determination whether t is equal to or greater than $\Delta t_{ON}$. If the determination at step 152 is negative the system proceeds to step 154 for a short time delay on the order of one to five seconds and then recycles to step 150. If the determination at step 152 is in the affirmative, the system proceeds to step 154 and turns off both the BAKE and BROIL burners.

The system is then set at step 156 for a burner OFF cycle time $\Delta t_{OFF}$ which in the present practice of the invention has been set for an elapsed period of one minute. The system then proceeds to step 158 and sets t=zero and then proceeds to read t at step 160. The system then makes the determination at step 162 as to whether t is equal to or greater than $\Delta t_{OFF}$; and, if the determination at step 162 is negative the system proceeds through a time delay on the order of one to five seconds at step 156 and recycles to step 160.

If the determination at step 162 is in the affirmative, the system recycles to step 146.

Figure 7:
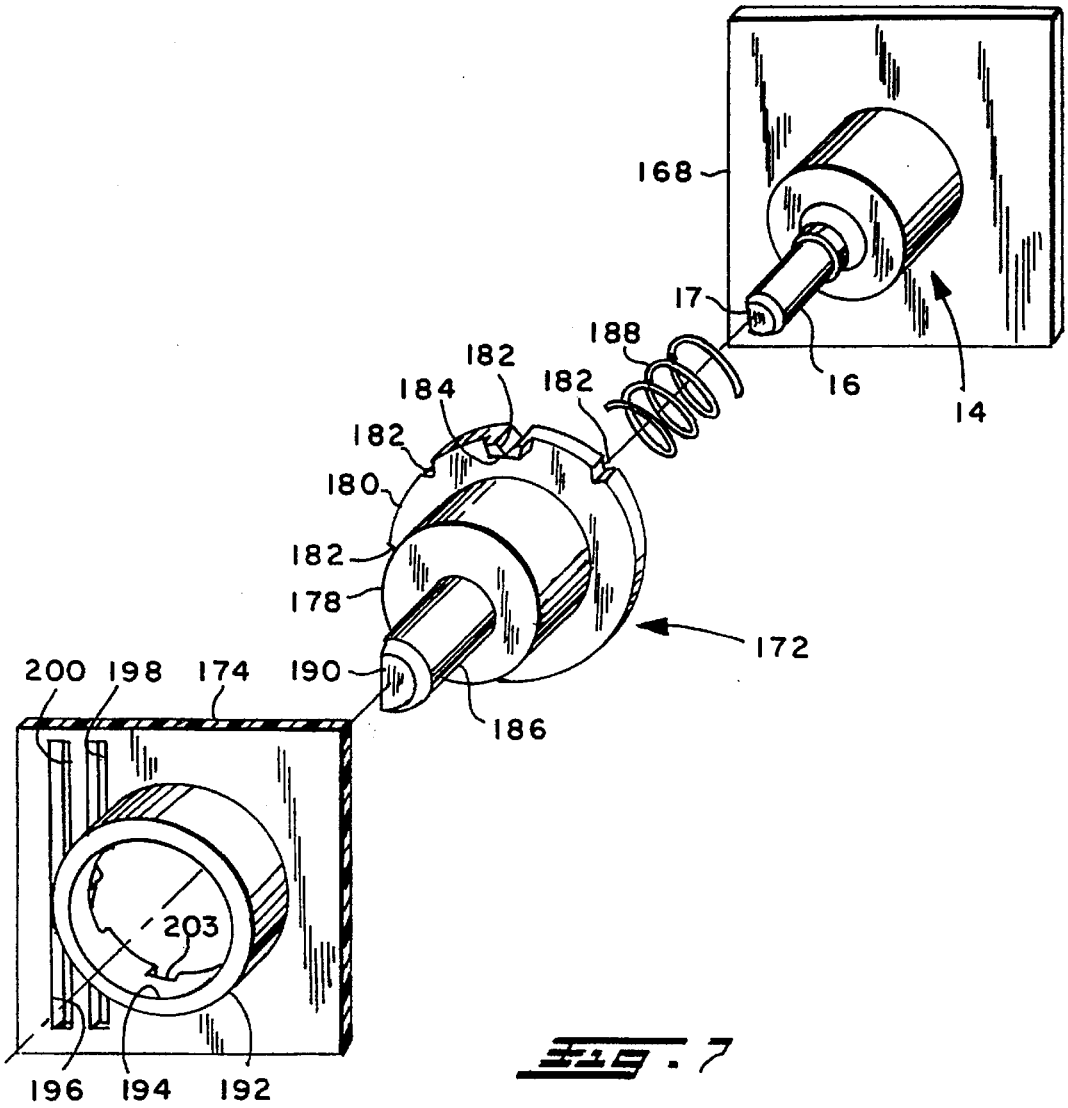
FIG. 7 is an exploded view of the user control input elements of the present invention.
Figure 6:
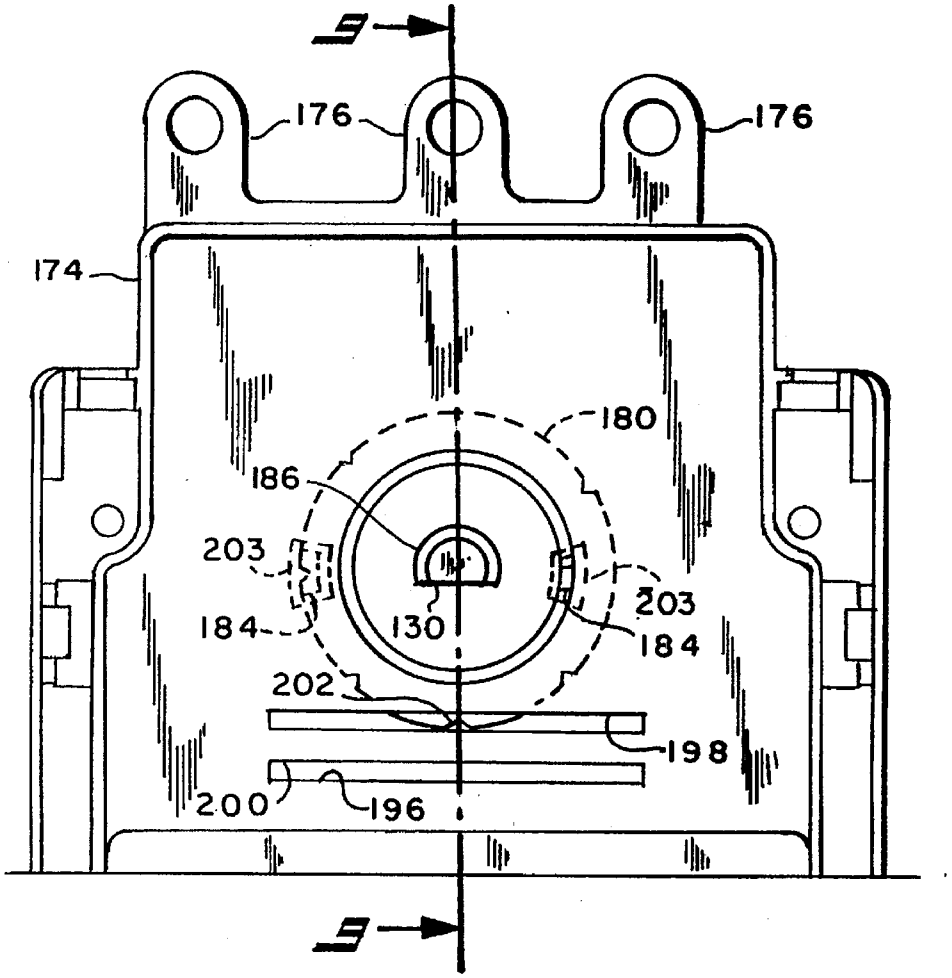
Figure 5:
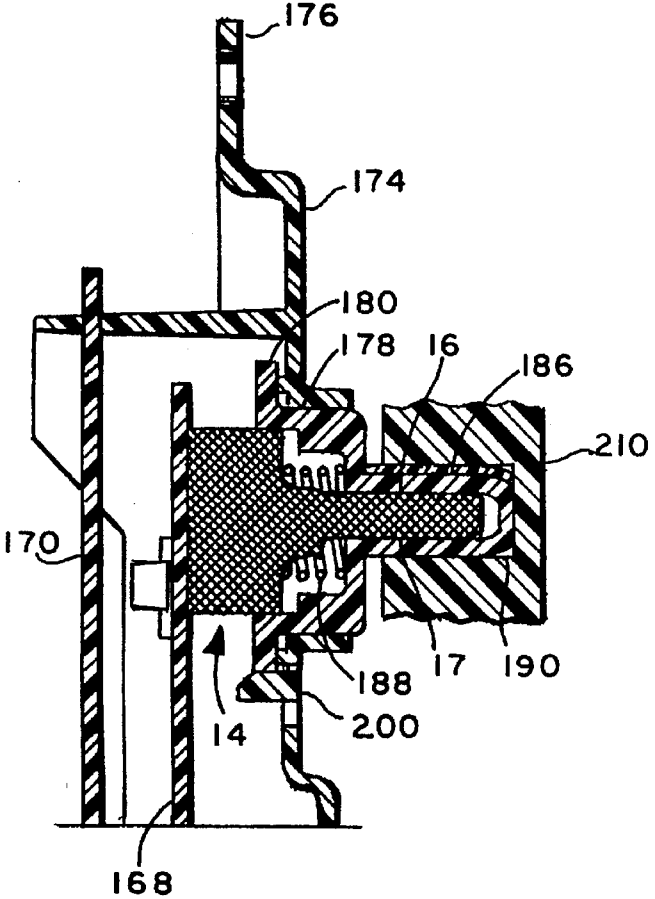

Referring to FIGS. 7, 8 and 9, the user input portion of the present control system is illustrated as having potentiometer 14 mounted on a circuit board 168 which is mounted on a control console housing 170, a detent hub indicated generally at 172 and a cover 174 which is adapted for attachment to a control housing 170 by means of mounting tabs 176. Hub 172 has an enlarged diameter portion 178 which has a generally hollow cylindrical configuration open at one end with an annular outwardly extending flange 180 formed at the open end thereof which flange has a plurality of notches or recesses 182 formed therein spaced about the periphery thereof. One of the recesses 182 is formed through an axially extending projection 184 extending from one axial face of the flange 180 and corresponds to the OFF position of arcuate segment 80 of the potentiometer.

Hub 172 has a reduced diameter portion 186 which has a hollow cylindrical configuration and is adapted to be axially assembled over the shaft 16 of the potentiometer in closely fitting driving engagement therewith. The hub 172 is biased to slide in an axially outward direction or a direction tending to separate the hub and the potentiometer by a coil spring 188 nested in the interior of the enlarged diameter portion 178. Hub portion 186 has a flat portion extending therealong denoted by reference numeral 190 and is thus configured to engage the flattened portion 17 of the potentiometer shaft in sliding engagement and is effective for torque transmission therebetween.

Cover 174 has an annular collar or projection 192 extending from the face thereof and having hub 172 journalled therein on the inner periphery 194 of the collar 192 for free rotation and axially sliding movement therein. The cover also has a pair of spaced generally parallel slots 196 and 198 formed therethrough which define therebetween a deflectable beam portion 200 which has extending into the slot 198 a projection or bulge 202 formed thereon which engages the notches or recesses 182 formed in the flange 180 of the detent hub, thereby locking the hub into the rotary position corresponding to the engagement of the particular one of the notches 182.

The axial projections 184 of hub 172 require a substantial movement by the user of the hub 172 in the axial direction toward the potentiometer 14 to disengage the projections 184 from the notches 203 to permit rotation of the hub from the position corresponding to the projection 184. Thus, the rotational position of the hub 172 and the potentiometer shaft 16 corresponding to the engagement of the projections 184 with the notches 203 may correspond to the "OFF" position for the potentiometer 14 requiring axial movement of or pushing of the hub 172 by the user in order to permit rotary movement of the hub and potentiometer shaft from the "OFF" position. It will be understood that an unshown user knob is engaged over the reduced diameter portion 186 of the detent hub to facilitate user movement thereof.

The present invention thus provides a push to turn actuation of a user control input to effect all electrical control of oven fuel gas burners and provides for automatic regulation of the oven temperature thereafter.

Although the present invention has been described hereinabove with respect to the illustrated embodiments, it will be understood by those skilled in the art that the invention is capable of modification and variation and is more particularly described in its scope by the following claims.

We claim:

1. An electrical control system for controlling gaseous fuel flow to an oven burner comprising:

(a) temperature sensor means operable to sense oven temperature and provide an oven temperature signal indicative thereof;

(b) a user operated rotary control having a push-to-release or push-to-turn function and rotatable thereafter and including a potentiometer rotated by the control for providing a reference voltage representative of a selected control position corresponding to a desired temperature;

(c) an electrically operated burner valve effective, upon connection to a source of gaseous fuel for controlling flow of the gaseous fuel to the oven burner;

(d) circuit means having a microprocessor operable to compare said oven temperature signal and said reference voltage and provide a temperature control signal based on said comparison; and, (e) relay means connected to said microprocessor for operating said burner valve in response to said temperature control signal.

2. The control system defined in claim 1, wherein said rotary control includes means for detenting said rotary control in predetermined positions.

3. The control system defined in claim 1, wherein said circuit means is operable to complete an ignitor energization circuit upon said rotary control being user-rotated to a predetermined position.

4. The control system defined in claim 1, further comprising oven control panel means having said rotary control mounted thereon, and with detenting means formed on said panel means.

5. The control system defined in claim 1, further comprising oven control panel means having said rotary control mounted thereon with detent means formed integrally therewith.

6. The control system defined in claim 1, further comprising oven control panel means having portions of said push-to-turn function mechanism formed integrally therewith.

7. The control system defined in claim 1, further comprising oven cabinet means having a control panel with said potentiometer mounted thereon said potentiometer having a rotatable shaft; and, said potentiometer has a detent ring received thereon, with a user-knob engaging said detent ring.

8. An electric control assembly for a gaseous fuel burner system comprising:

(a) control console means having a potentiometer with a rotating shaft mounted thereon;

(b) a control panel disposed in front of said potentiometer;

(c) an annular hub member received on said shaft in rotary driving engagement and axial telescoping or sliding arrangement, said hub member having portions thereof extending through said panel with a knob thereon;

(d) detent spring means formed integrally with said panel and engaging said annular hub member for, upon user rotation of said knob, effecting a detenting function;

(e) engageable locking means operable upon axial movement of said hub member toward said panel and preventing rotation of said hub means, said locking means operative upon movement of said hub means in a direction away from said panel for disengagement unlocking said hub member for rotational movement; and, (f) knob means attached to said hub means for user manual rotation thereof.

9. The control assembly defined in claim 8, wherein said control panel and detent spring are formed of molded plastic.

10. The control assembly defined in claim 8, wherein said annular hub member, said knob means, said control panel and said detent spring means are formed of molded plastic.

11. The control assembly defined in claim 8, wherein said annular member and said panel means define cooperating surfaces mutually interengaging to require user axial movement of the knob to effect disengagement and to permit user rotation of said knob.

12. The control assembly defined in claim 8, further comprising means biasing said hub towards said panel.

13. A method of controlling flow of gaseous fuel in a supply line from a source to an oven burner comprising:

(a) sensing the oven temperature and generating an oven temperature indicative of the sensed temperature;

(b) disposing an electrically operated valve in said line between said source and said burner;

(c) rotating a shaft and varying the resistance of a potentiometer providing an oven temperature signal and providing a reference voltage indicative of a desired oven temperature;

(d) inputting said temperature signal and said reference voltage to a microprocessor and comparing said reference voltage and said oven temperature signal and generating a control signal indicative of the comparison;

(e) applying said control signal to a relay and opening said valve by an amount related to the value or level of said control signal; and, (f) initially locking said shaft against rotation and axially moving said shaft for unlocking and rotating said shaft and varying the portion of said potentiometer.

14. The method defined in claim 13, wherein said step of rotating a shaft includes detenting certain rotational positions of the shaft.

15. The method defined in claim 13, wherein said step of rotating a shaft includes moving said shaft axially and unlocking said shaft.

* * * * *

UNITED STATES PATENT AND TRADEMARK OFFICE

CERTIFICATE OF CORRECTION

PATENT NO. : 5,662,465
DATED : September 2, 1997
INVENTOR(S) : YOSHIO W. KANO

It is certified that error appears in the above-identified patent and that said Letters Patent is hereby corrected as shown below:

COLUMN 8, AT LINE 34, "portion" should read -- position - - .

Signed and Sealed this

Twenty-third Day of December, 1997

Bruce Lehman

*Attest:*

BRUCE LEHMAN

*Attesting Officer*

*Commissioner of Patents and Trademarks*